US006294022B1

(12) United States Patent
Eslambolchi et al.

(10) Patent No.: US 6,294,022 B1
(45) **Date of Patent: *Sep. 25, 2001**

(54) SPRAY PAINT MARKING TOOL

(75) Inventors: Hossein Eslambolchi, Basking Ridge, NJ (US); John Sinclair Huffman, Conyers, GA (US)

(73) Assignee: AT&T Corp., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/343,744

(22) Filed: Jun. 30, 1999

(51) Int. Cl.[7] ..... B05B 7/06; B41F 15/00; B41L 13/00

(52) U.S. Cl. ..... 118/315; 118/305; 222/473; 101/114

(58) Field of Search ..... 118/301, 305, 118/313, 315; 239/150; 101/114, 126, 125, 127; 222/174, 402.14, 402.15, 473, 474

(56) References Cited

U.S. PATENT DOCUMENTS

| | | | | |
|---|---|---|---|---|
| 4,048,918 | * | 9/1977 | Peck | 101/114 |
| 5,368,202 | * | 11/1994 | Smrt | 222/174 |
| 6,062,443 | * | 5/2000 | Smrt | 222/608 |

* cited by examiner

*Primary Examiner*—Richard Crispino
*Assistant Examiner*—Yewebdar T Tadesse

(57) ABSTRACT

A hand-held spray paint marking tool includes a lower chamber for holding at least one can of spray paint in an inverted position. The chamber extends upward and terminates in a handle grip that includes an activation mechanism. A stencil including the desired marking pattern is attached to the underside of the lower chamber. When the activation mechanism is depressed by the user, the spray paint cans are activated such that the paint passes through the stencil and marks the ground underneath.

2 Claims, 2 Drawing Sheets

SPRAY PAINT MARKING TOOL

TECHNICAL FIELD

The present invention relates to a spray paint marking tool and, more particularly, to a hand-held spray paint marking tool including a single button activation mechanism.

BACKGROUND OF THE INVENTION

During the plant protection of fiber optic cables, technicians are often required to mark the electronic location of a buried cable facility. The marking is intended to allow contractors to avoid buried cable location during digging operations. Spraying a water-soluble paint on the ground is the usual method for providing this type of marking. Since the paint tends to wash off or wear away after two or three days, the buried cable location needs to be frequently re-marked to keep the contractors aware of the buried facility. Additionally, most state one-call laws require utility companies to identify the marked facility by the company name and by the standard color code of the buried facility. For example, any facility marked by an AT&T technician must have the words AT&T Buried Fiber Optic Cable on the mark for identification. In addition, the 800-call back number is also required to allow the digging contractor to call if there is a problem with the electronic locates.

The prior art method of providing this type of company-ID marking is to manually write the identification of the facility with a paint spray can. The marking, therefore, is only as legible as is possible for the technician to achieve. In situations where a technician is required to mark a large number of locations, the marking may become illegible and, as a result, of little use. A need remains, therefore, for an improved system of marking the location of buried cable facilities.

SUMMARY OF THE INVENTION

The need remaining in the prior art is addressed by the present invention, which relates to a spray paint marking tool and, more particularly, to a hand-held spray paint marking tool including a single button activation mechanism.

A spray paint marking tool in accordance with the present invention comprises a spray paint can chamber for holding one or more cans of paint, with the cans held upside down so that the paint exits through the bottom of the chamber. A marking stencil is held in place across the bottom surface of the chamber in a manner such that the paint exiting the can(s) will contact the stencil and thus form a spray-painted marking on the ground immediately below the chamber. An extension arm, terminating in a control handle, is attached to the chamber. The control handle includes an activation mechanism which is coupled through the extension arm to the spray paint chamber. In operation, therefore, a technician can squeeze a trigger (or any other suitable type of activation mechanism) on the handle, activate the spray paint can(s) and paint through the stencil to mark the ground. The use of the stencil insures that each mark will be identical and legible.

In a preferred embodiment of the present invention, the spray paint chamber is formed to include a pair of channels in its bottom surface to accommodate the insertion and removal of a stencil. Since the stencil will quickly become paint covered, the ability to remove and clean the stencil is advantageous. The ability to remove the stencil also allows for various different stencils to be used with the same marking tool.

Other and further advantages of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
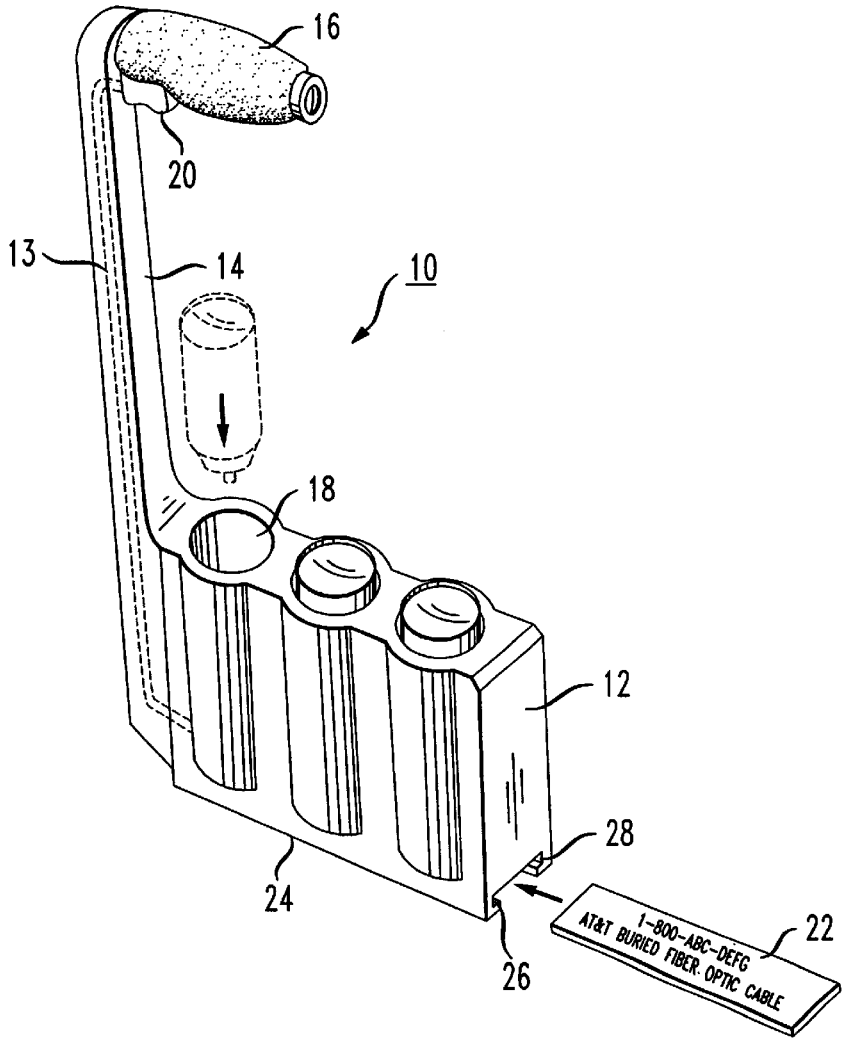
FIG. 1 is an isometric view of an exemplary spray paint marking tool of the present invention.

An exemplary spray paint marking tool 10 is shown, in an isometric view, in FIG. 1. Marking tool 10 includes a spray paint chamber 12, an extension arm 14 and an activation handle 16. Chamber 12 includes one or more (preferably more than one) openings 18 for insertion of a can of spray paint (illustrated in phantom). Included with handle 16 is an activation trigger 20, where trigger 20 is connected through extension arm 14 to spray paint chamber 12. A spray paint stencil 22 is removably attached to the bottom surface 24 of chamber 12. In the embodiment illustrated in FIG. 1, chamber 12 is formed to include a pair of C-channels 26,28 so that stencil 22 may be slid into and out of position with respect to bottom surface 24 of chamber 12.

Figure 2:
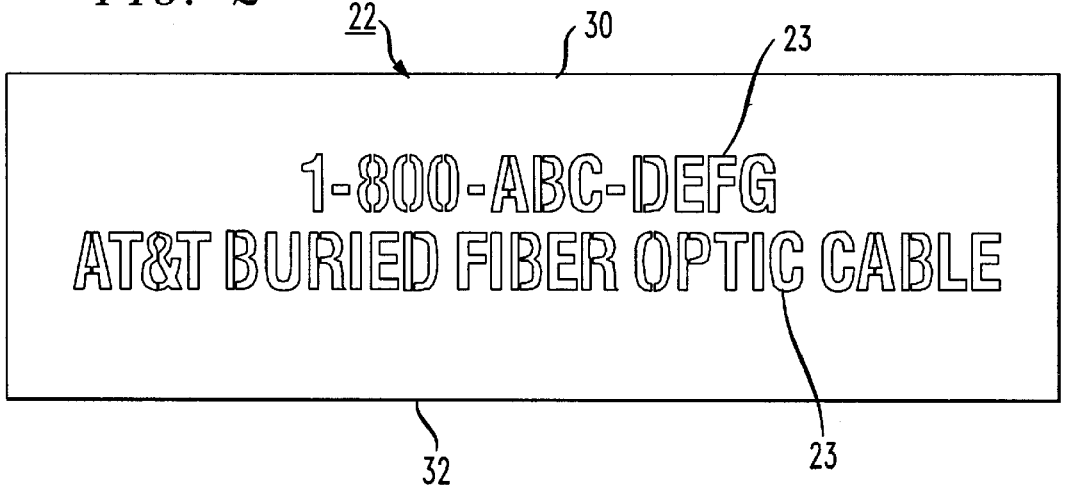
FIG. 2 illustrates an exemplary stencil that may be used with the marking tool of FIG. 1.

Once stencil 22 is in place, a technician can activate marking tool 10 merely by depressing activation trigger 20. Trigger 20, which may be coupled via a cable 13 to chamber 12, functions to depress the spray paint can(s) disposed in openings 18 so as to initiate the release of the paint from the cans. Thereafter, the paint will pass through the openings 23 in stencil 22 (as shown in FIG. 2) and apply the required mark on the ground underneath tool 10. An advantage of the removability of stencil 22 is that the stencil may be cleaned, as often as needed, to insure that a clear mark is made on the ground. Also, since the markings may need to be changed (depending upon the type of buried cable, for example, or depending upon the owner of the cable), the removability of the stencil allows for the marking tool to be used with a variety of different stencils.

An exemplary stencil 22, which may be used by AT&T to mark the location of an underground fiber optic cable, is shown in FIG. 2. The stencil as shown in rectangular in shape and includes an opening 23 formed as a set of markings including a toll-free number to call and an identity of the cable type and owner of the cable. It is to be understood that the type of information contained on the stencil openings is not germane to the subject matter of the present invention and, in fact, the spray paint marking tool has a variety of uses beyond the marking of buried cables. For example, sports field markings may be applied using the tool of the present invention, as well as site markings associated with survey tasks, various construction site markings, and more. In the arrangement of the present invention as illustrated in FIGS. 1 and 2, edges 30,32 of stencil 22 may be slid into C-channels 26,28 so as to align stencil 22 with the position of spray paint openings 18 in chamber 12.

Figure 3:
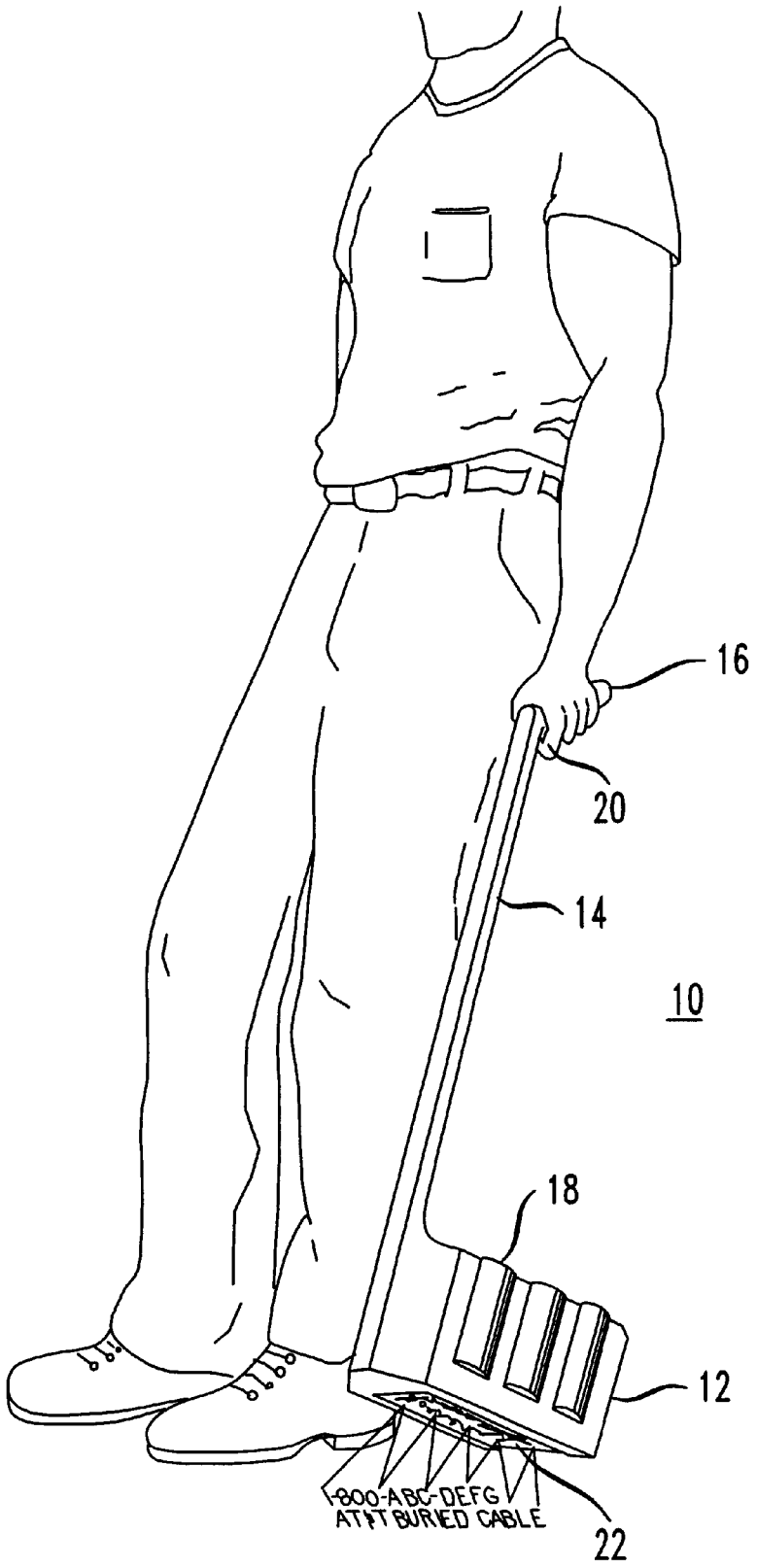
FIG. 3 is an illustration of a technician (in phantom) working the spray paint marking tool of the present invention.

FIG. 3 illustrates the use of spray paint marking tool 10 to apply a buried cable marking on the ground. As shown, a technician (illustrated in phantom in FIG. 3) grips marking tool 10 at handle 16 and squeezes activation mechanism 20 on handle 16. By squeezing activation mechanism 20, cable 13 will be moved so as to force, for example, a lever arm against the spray paint cans to cause their activation. When activated, the paint will be released from the cans, pass through openings 23 in stencil 22 and, as shown, in FIG. 3, mark the ground area underneath marking tool 10.

Although the above discussion has been directed to using a spray marking tool for identifying the location of buried cable, it is to be understood that the spray paint marking tool of the present invention can be used in any situation where it is desired to provide a marking (usually temporary) on a ground surface. Further, while the specific illustrated embodiment of the present invention illustrated the use of a set of three spray paint cans within the tool, it is to be understood that the chamber section of the marking tool may be formed to hold any desired number of spray paint cans. In general, the spirit and scope of the present invention is considered to be limited only by the claims which are appended hereto.

What is claimed is:

1. A spray paint marking tool comprising a lower chamber comprising a plurality of openings for holding a plurality of spray paint containers in an inverted position;

a tool handle grip allowing for said tool to be held in one hand, the tool handle grip including an activation trigger;

an extension arm connected at one end to the lower chamber and an opposite end to said tool handle grip, said extension arm including a single activation mechanism coupled between said activation trigger and said lower chamber so as to cause the simultaneous release of paint from the plurality of spray paint containers upon release of said activation trigger; and a marking stencil attached to said lower chamber and disposed such that released paint will pass through said marking stencil and mark an area underneath said marking tool.

2. A spray paint marking tool as defined in claim 1 wherein the lower chamber further comprises a channel region for holding the marking stencil.

* * * * *